US010039403B2

(12) United States Patent
Dubois

(10) Patent No.: US 10,039,403 B2
(45) Date of Patent: Aug. 7, 2018

(54) BOX PLEAT CURTAIN

(71) Applicant: Elizabeth Dubois, West Warwick, RI (US)

(72) Inventor: Elizabeth Dubois, West Warwick, RI (US)

(73) Assignee: CORONA CURTAIN MANUFACTURING, West Warwick, RI (US)

( * ) Notice: Subject to any disclaimer, the term of this patent is extended or adjusted under 35 U.S.C. 154(b) by 0 days.

(21) Appl. No.: 15/240,415

(22) Filed: Aug. 18, 2016

(65) Prior Publication Data

US 2017/0143150 A1 May 25, 2017

Related U.S. Application Data

(63) Continuation-in-part of application No. 29/546,475, filed on Nov. 23, 2015, now abandoned.

(51) Int. Cl.
*A47H 13/14* (2006.01)
*A47H 23/02* (2006.01)

(52) U.S. Cl.
CPC ..... *A47H 13/14* (2013.01); *A47H 23/02* (2013.01); *A47H 2023/025* (2013.01)

(58) Field of Classification Search
CPC ... A47H 13/14; A47H 23/02; A47H 2023/025
See application file for complete search history.

(56) References Cited

U.S. PATENT DOCUMENTS 2,573,441 A * 10/1951 Hess ..... A47H 13/14 160/348
2,629,435 A * 2/1953 Dadswell ..... E05F 13/02 16/DIG. 7
2,789,637 A * 4/1957 Phillips ..... A47H 13/14 160/348

(Continued)

FOREIGN PATENT DOCUMENTS

FR 2809749 A1 * 12/2001

OTHER PUBLICATIONS

Erlam, Linda; Demand Media, Web article—"How to Get Grommet Drapes to Hang in Pleats" (date unknown).

(Continued)

*Primary Examiner* — Blair M Johnson
(74) *Attorney, Agent, or Firm* — Barlow, Josephs & Holmes, Ltd.

(57) ABSTRACT

A curtain or drapery panel that is formed having hanging grommets and box pleats along the header band that provides support to allow the box pleats to retain their shape without deforming. The drapery is a fabric panel having a header strip along the top thereof. The header strip has a plurality of spaced apart grommets. Between alternating grommets the fabric is pinched together to form a forward facing bow or loop. The bow or loop is then flattened and the top and bottom edges of the loop along the header strip are sewn down to the header strip to flatten the loop into a rectangular flat gathered pleat. Further, the edges of the pleat along the header strip may also be sewn to give it a more defined crisp edge. This draws two adjacent grommets close together on the two opposing sides of the newly formed pleat.

10 Claims, 4 Drawing Sheets

(56) References Cited

U.S. PATENT DOCUMENTS

| | | | | |
|---|---|---|---|---|
| 3,442,319 | A * | 5/1969 | Barbour | A47H 13/14 160/330 |
| 2004/0045684 | A1* | 3/2004 | Smith | A47H 13/14 160/348 |
| 2007/0246174 | A1* | 10/2007 | Barrese | A47H 1/02 160/330 |
| 2015/0114579 | A1* | 4/2015 | Baines | A47H 23/02 160/330 |
| 2017/0143150 | A1* | 5/2017 | Dubois | A47H 13/14 |

OTHER PUBLICATIONS

Posted by Katja—Web article—"How to: turn a grommet-top curtain into a back tab curtain" (date unknown).
Web article—"Curtain Hack Tutorial (No Sew): Pleated Drapes from Grommet Panels" (date unknown).
Web article—"IKEA Hack: Converting a Grommet Curtain Header to Pencil Pleats," Monday, Mar. 23, 2015.
Web article—"Draperies with Pleats and Grommets" (date unknown).
Web article—House & Garden, "Drapery Pleat Styles" (date unknown).
Damour, Pam; Web article—"The Perfect Panel" (date unknown).

* cited by examiner

BOX PLEAT CURTAIN

CROSS-REFERENCE TO RELATED APPLICATIONS

This application is related to and claims priority from earlier filed U.S. patent application Ser. No. 29/546,475, filed Nov. 23, 2015.

BACKGROUND OF THE INVENTION

The present invention relates generally to a box pleat structured curtain. More specifically, the present invention relates to a curtain wherein the top of the panel is formed using grommets in a manner that assists is structuring the top of the curtain into a box pleat form.

Curtains and draperies are normally supported from a curtain rod using drapery hardware. For example clip rings are well known drapery hardware used for hanging drapery and curtains. A clip ring generally comprises a simple ring with a clip extending therefrom. The ring is arranged to fit around a drapery rod such that it is easily slidable along the length thereof. The clip is arranged to hang below the rod and securely grip a portion of the fabric of the drapery.

Generally, a plurality of clip rings, arranged in succession along the length of the rod, is used to hang the drapery. As the clip rings are easily slidable along the rod, a user may easily position the drapery hanging therefrom at desired locations along the rod. When the drapery is gathered together, its fabric tends to bunch and fold, especially near the upper portion of its fabric where the clip rings are gripping it. Consequently, drapery is often provided with pleats in order to provide an aesthetically pleasing means for gathering the bunched and folded fabric.

Pleats or pleat assemblies are generally made by forming a sharply defined fold or group of several closely spaced folds in the heading, and preserving the folds by sewing or other means. A multitude of such pleats are uniformly spaced along the heading. The size of the folds of the pleats and their spacing is generally such as to produce a pleated heading having about half the length of the initial unpleated heading. The drapery supporting hooks, usually S-shaped wires pointed at one end, generally engage the rear of the pleats.

Several well-known types of pleats are recognized, such as the pinch, box and cartridge styles, each fabricated by a specialized method and having a distinct appearance. For example, a pinch pleat, also known as a French pleat, is made by first forming a vertically oriented loop protruding toward the face of the drape and extending the height of the heading. The loop is then sewn closed at its base and fashioned into three smaller loops or folds by gathering and shaping the protruding fabric and pushing it back toward the rear of the drapery. The center loop, at its rear-most extremity, is bounded by two bends, sometimes referred to as bights. The three loops are joined or pinched together by sewing in a direction perpendicular to the face of the drape just below the heading, forming a seam, generally called a bar tacking, which stabilizes the folded structure. Because the center loop is not attached at its bottom, and the three loops are secured laterally at one point, the appearance is that of three loops beginning at the top of the drapery, converging just below the heading, and diverging and leading into the undulations of the body of the drapery. Although the bights are sharply defined near the bar tacking, they are diffuse near the upper portion of the heading.

A box pleat is made by initially forming a vertically sewn loop, as in the case of the pinch pleat. The loop is then flattened against the heading, as by pressing, and the top and bottom portions of the flattened loop are horizontally sewn to the heading. A cartridge pleat is similar to a box pleat, but instead of being flattened, the loop remains in its full, protruding configuration.

The use of sewing techniques in fabricating pleats is slow and costly. Also, in the case of large pleats, sewing does not provide adequate stiffness for shape retention. Faster techniques for making pleats are desirable, and may involve stamping-type operations whereby a pleat-making means repeatedly acts upon the heading of a drapery run horizontally past the pleat-making unit. In order, however, for a pleat to be amenable to fabrication by fast automated methods such as a stamping technique, special innovations must be made in the design of the pleat itself. For example, pinch pleats containing a bar tacking are not readily amenable to fabrication by a simple stamping method.

In the prior art, pleated window treatments have been hung on support rods by the means of metal hooks that have one end shaped to engage a support rod and the other end affixed to a reinforcing band of material that is affixed to the upper edge of the pleated window treatment. The metal hooks have been attached to reinforcing band of material by the insertion of a sharpened end of the metal hook or by being sewn or fixed to the band of material by a suitable fastener.

The applicant has devised a means of structuring a box pleated window treatment which avoids the need to use metal hooks or a reinforcing band of material as a mounting means on the upper inside part of the pleated window treatment for the purpose of receiving metal hooks that are used to engage a rod.

Thus, there is a need for a means for forming and maintaining pleats in the fabric of drapery that is not time-consuming, arduous, nor requires specialized skill and knowledge. There is also a need for such a means that does not require sewing or otherwise permanently altering the fabric of the drapery.

BRIEF SUMMARY OF THE INVENTION

In this regard, the present invention provides for a curtain or drapery panel that is formed having hanging grommets and box pleats along the header band thereof. The structure of the present drapery panel provides a great deal of support to allow the box pleats to retain their shape without deforming while also allowing the drapery to be removed from the packaging and installed with little effort on the part of the consumer. This is contrasted with the prior art pleating systems that required painstaking effort to create a neat and uniform appearing box pleat window treatment.

The drapery panel of the present invention is a fabric panel having a header strip along the top thereof. The header strip has a plurality of spaced apart grommets with openings installed therein. The grommets form the holes through which a curtain rod is installed to support the drapery panel in an installed position in a window.

Between alternating grommets the fabric is pinched together to form a forward facing bow or loop. The bow or loop is then flattened and the top and bottom edges of the loop along the header strip are sewn down to the header strip to flatten the loop into a rectangular flat gathered pleat. Further, the edges of the pleat along the header strip may also be sewn to give it a more defined crisp edge. This draws two adjacent grommets close together on the two opposing sides of the newly formed pleat.

By structuring the header of the drapery panel in this manner, as the panel is installed onto a rod and gathered the grommets form a support structure that runs forward and backward along the rod providing rigid structuring for the sides of the box pleat while the stitched pleat between the grommets forms a defined structure for the forward facing front sections of the curtain. As a result an easily installed and well-structured box pleat curtain is formed that can be hung directly out of the packaged and still produce the structured box pleat appearance desired.

It is therefore an object of the present invention to provide a drapery panel having a box pleat header strip that has alternating grommets and box pleat sections. It is a further object of the present invention to provide a drapery panel with a structured box pleat appearance that can be installed onto a curtain rod for display without any additional requirements to create a durable box pleat. There is a further object of the present invention to provide a drapery panel with a structured box pleat header that is self-supporting and does not require the addition of any further curtain hanging hardware as was typically required in the prior art.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
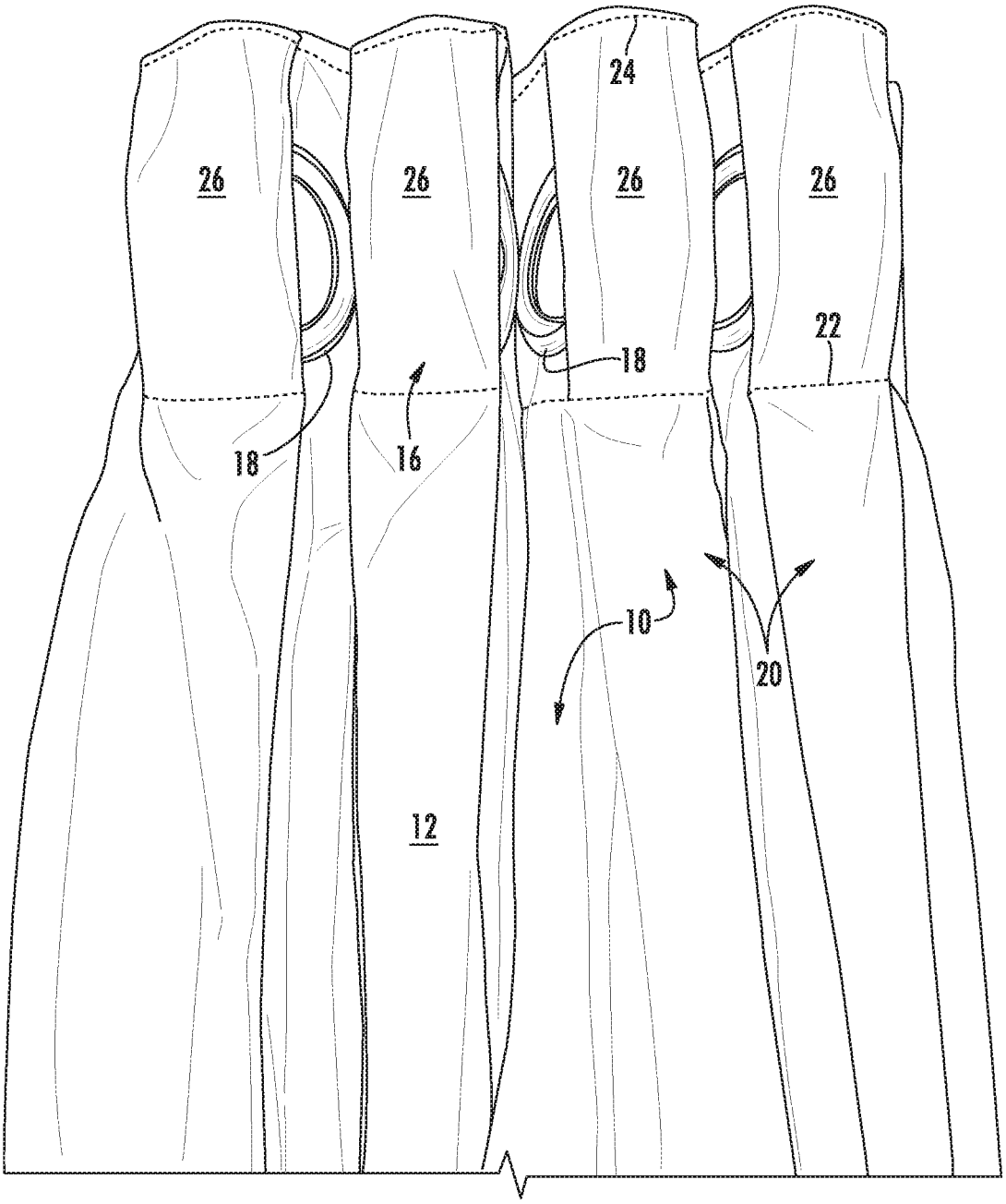
FIG. 1 is a front perspective view of the drapery panel of the present invention.

Now referring to the drawings, the drapery panel 10 of the present invention is shown and generally illustrated in the figures. As can be seen, the drapery panel is a fabric panel having a header strip along the top thereof. The header strip has a plurality of spaced apart grommets with openings installed therethrough. The grommets form the holes through which a curtain rod is installed to support the drapery panel in an installed position in a window.

The present invention as best can be seen at FIG. 1 provides for a box pleat structure at the top of the drapery panel 10. The drapery consists of a panel of fabric 12. The fabric may be of any type known in the art suitable for a window treatment. Further, the fabric panel may be lined, coated, insulated or unlined as is indicated for the final application of the drapery panel. The general construction of the drapery panel will not be discussed further herein as general construction materials and methods are already well known in the art.

Figure 2:
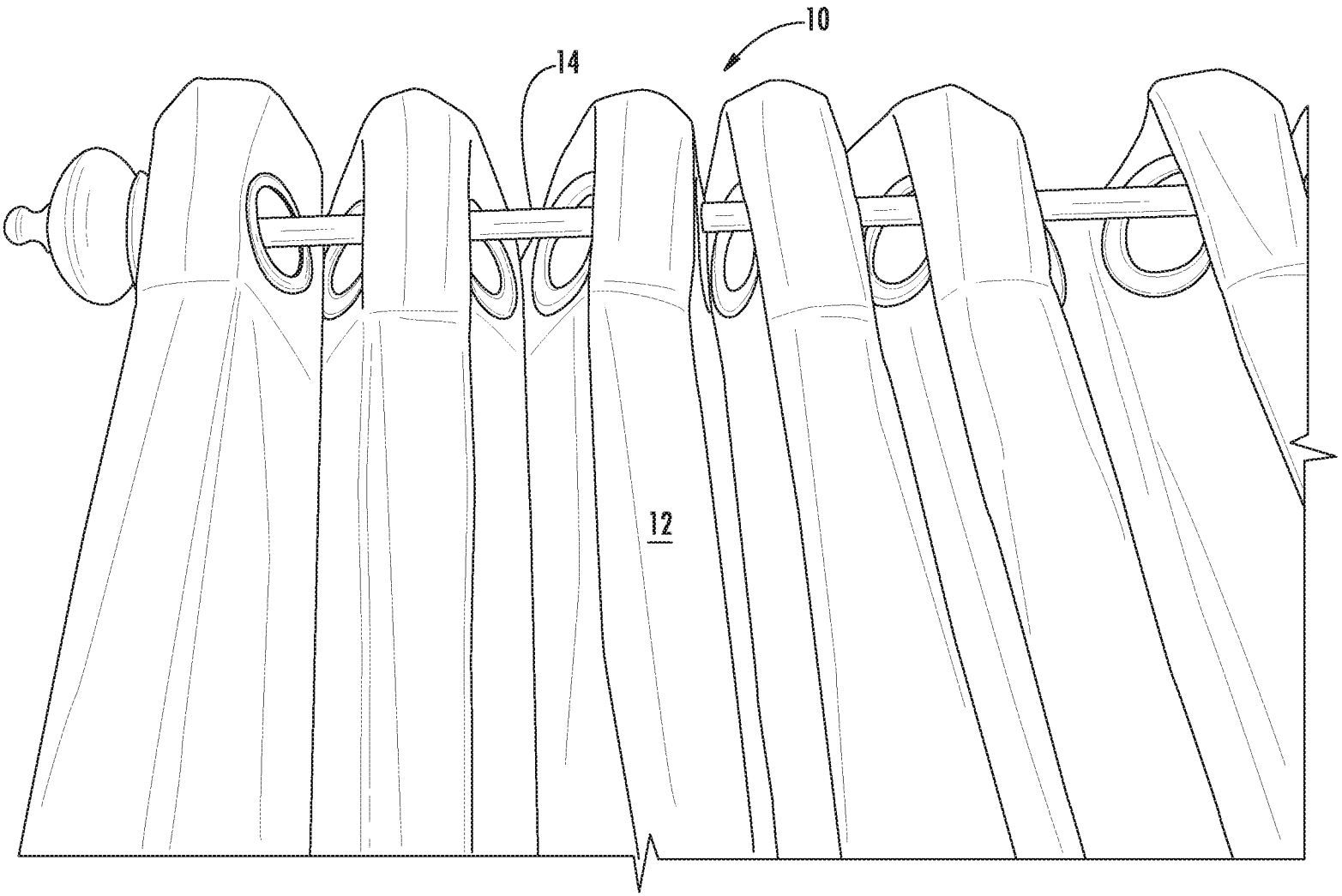
FIG. 2 is a front perspective view of the drapery panel of the present invention displayed on a curtain rod.

As seen in FIG. 2, when placed onto a curtain rod 14, the box pleat panel, constructed as will be further discussed below forms a relatively flat front pleat with structured sides that run perpendicular to the supporting rod and the relatively flat front pleat.

Along the top of the fabric panel 10 a header strip 16 is formed. The header strip 16 may be folded over fabric, a reinforcement tape, simply the fabric itself or a combination thereof. The header strip 16 preferably runs the length of the drapery panel. Grommets 18 are installed into the header strip 16 in spaced apart locations. The grommets 18 are preferably large enough to provide significant structural support to the header strip 16 at the locations where they are installed. In this manner, as will be described in more detail below, when the grommets are placed on the curtain rod they add structure to the box pleated panel. The grommets are preferably of any suitable material and may be metal or plastic reinforcements.

Figure 3:
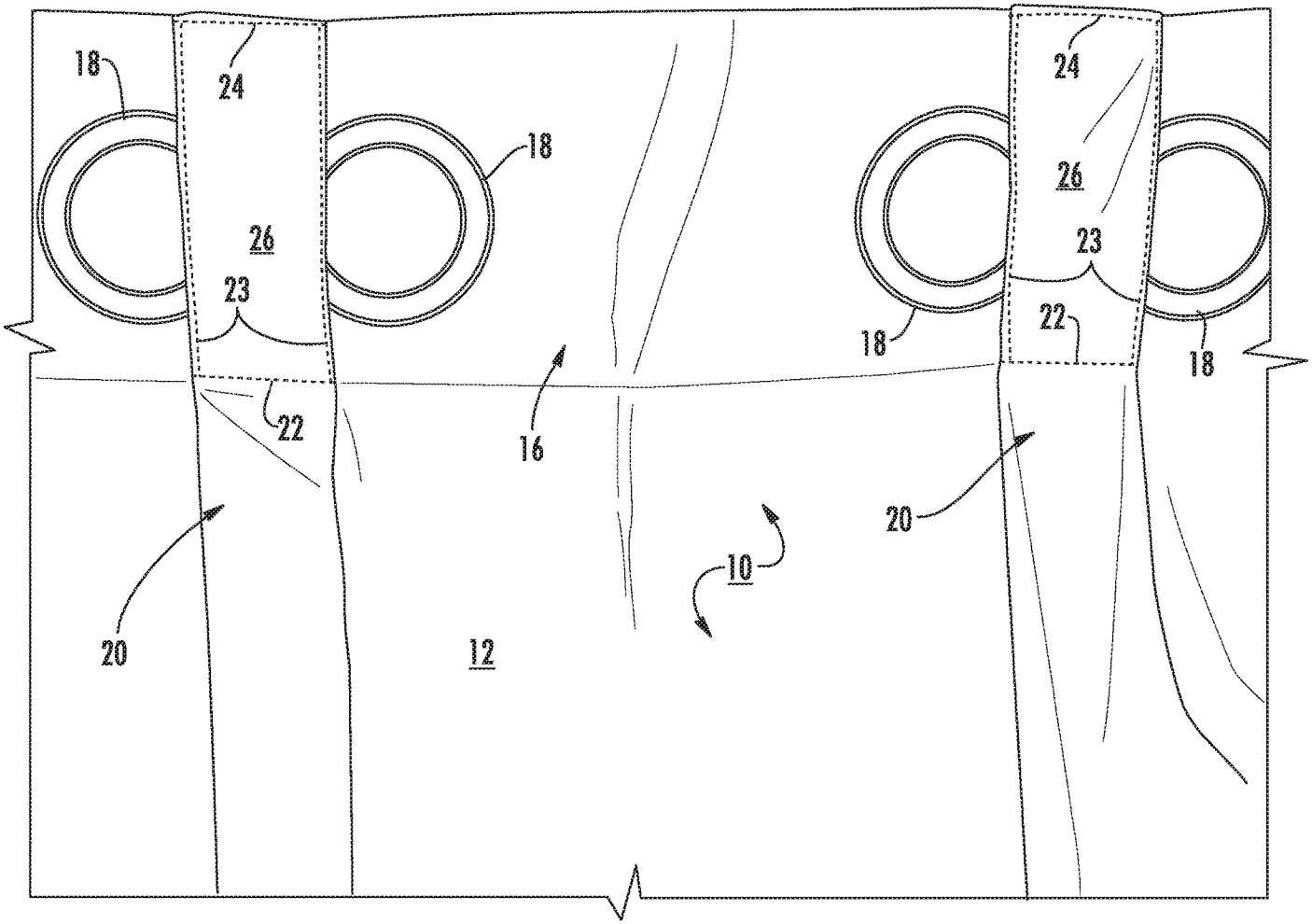
FIG. 3 is a flattened front view of the drapery panel of the present invention.
Figure 4:
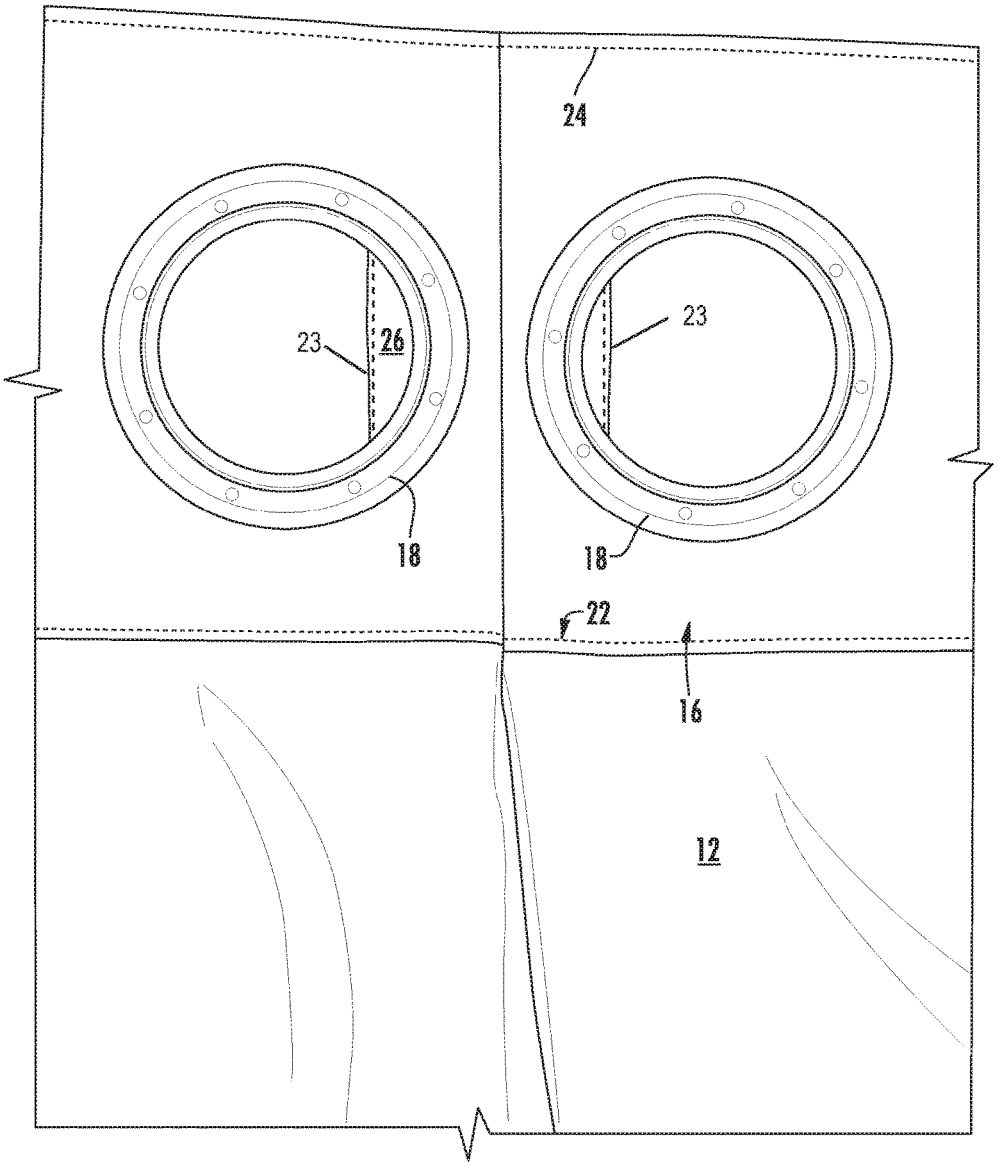
FIG. 4 is a flattened rear view of the drapery panel of the present invention.

As can best be seen at FIGS. 3 and 4, along the header strip 16 and between alternating grommets 18 the fabric is pinched together to form a forward facing bow or loop 20. The bow or loop 20 is then flattened and the top and bottom edges 22, 24 of the loop along the header strip 16 are sewn down to the header strip to flatten the loop into a rectangular flat gathered pleat 26. Further, the edges of the pleat along the header strip may also be sewn to give it a more defined crisp edge. This draws two adjacent grommets 18 close together on the two opposing sides of the newly formed pleat 26.

By structuring the header of the drapery panel in this manner, as the panel is installed onto a rod and gathered the grommets form a support structure that runs forward and backward along the rod providing rigid structuring for the sides of the box pleat while the stitched 23 pleat 26 between the grommets forms a defined structure for the forward facing front sections of the curtain. As a result an easily installed and well-structured box pleat curtain is formed that can be hung directly out of the packaged and still produce the structured box pleat appearance desired.

It can therefore be seen that the present invention provides a drapery panel having a box pleat header strip that has alternating grommets and box pleat sections having with a structured box pleat appearance that can be installed onto a curtain rod for display without any additional requirements to create a durable box pleat. Further the present invention provides a drapery panel with a structured box pleat header that is self-supporting and does not require the addition of any further curtain hanging hardware as was typically required in the prior art. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A drapery panel, comprising:

a fabric panel having a header strip along a top edge thereof;

a plurality of spaced apart grommets affixed in said header strip and said fabric panel; and pleats formed between the grommets of each of pairs of grommets, said pleats being formed from a gathered loop of the fabric panel and the header strip between said grommets of each pair, said loop being flattened to form a substantially rectangular forward facing pleat wherein said flattened loop of fabric panel and header strip is sewn to said header strip along a top and bottom edge thereof.

2. The drapery panel of claim 1, wherein said grommets reinforce the header strip to form sides for a box pleat when said drapery panel is installed on a curtain rod.

3. The drapery panel of claim 1, wherein said header strip includes a reinforcing tape affixed to said fabric panel.

4. The drapery panel of claim 1, wherein said rectangular forward facing pleat cooperates with said grommets to create three sides of a box pleat when said drapery panel is installed on a curtain rod.

5. The drapery panel of claim 1, wherein said flattened loop is stitched along a left and right side thereof.

6. A box pleated header strip on a drapery panel, comprising:

a header strip along a top edge of a drapery panel;

a plurality of spaced apart grommets affixed in said header strip and said drapery panel; and pleats formed between the grommets of each of pairs of grommets, said pleats being formed from a gathered loop of drapery and header strip between said grommets of each pair, said loop being flattened to form a substantially rectangular forward facing pleat wherein said flattened loop of the drapery panel and the header strip is sewn to said header strip along a top and bottom edge thereof.

7. The header strip of claim 6, wherein said grommets reinforce the header strip to form sides for a box pleat when installed on a curtain rod.

8. The header strip of claim 6, wherein said header strip includes a reinforcing tape affixed to said drapery panel.

9. The header strip of claim 6, wherein said rectangular forward facing pleat cooperates with said grommets to create three sides of a box pleat when installed on a curtain rod.

10. The header strip of claim 1, wherein said flattened loop is stitched along a left and right side thereof.

* * * * *